United States Patent [19]

Feenan et al.

[11] 4,346,362

[45] Aug. 24, 1982

[54] ELECTRIC FUSES WITH REGIONS OF REDUCED CROSS-SECTIONAL AREA

[75] Inventors: John Feenan; Ronald V. Wafer, both of Liverpool, England

[73] Assignee: The English Electric Company Limited, London, England

[21] Appl. No.: 192,014

[22] Filed: Sep. 29, 1980

[30] Foreign Application Priority Data

Oct. 10, 1979 [GB] United Kingdom ..... 7935213

[51] Int. Cl.[3] ..... H01H 85/02

[52] U.S. Cl. ..... 337/248; 337/159; 337/278

[58] Field of Search ..... 337/248, 249, 250, 251, 337/268, 273, 274, 275, 276, 277, 278, 279, 280, 281, 282, 158, 159, 160, 161, 162

[56] References Cited

U.S. PATENT DOCUMENTS

| | | | |
|---|---|---|---|
| 1,120,226 | 12/1914 | Murray, Jr. | 337/278 |
| 1,502,881 | 7/1924 | Sandin | 337/248 |
| 2,892,061 | 6/1959 | Kozacka | 337/159 |
| 3,007,020 | 10/1961 | Kozacka | 337/159 |
| 4,001,748 | 1/1977 | Salzer | 337/159 |
| 4,158,187 | 6/1979 | Perreault | 337/248 |

*Primary Examiner*—Harold Broome

*Attorney, Agent, or Firm*—Kirschstein, Kirschstein, Ottinger & Cobrin

[57] ABSTRACT

An electric fuse according to this invention incorporates metal end caps and an elongate fuse element having regions of reduced cross-sectional area and extending in electrical series between the metal end caps, wherein the fuse incorporates within each end a respective gasket of an absorbent material impregnated with an arc-inhibiting substance. Materials which have been found to be particularly effective for the gaskets are asbestos and absorbent types of paper, including strawboard and cardboard, impregnated with an arc-inhibiting compound constituted, suitably, by sodium silicate.

5 Claims, 1 Drawing Figure

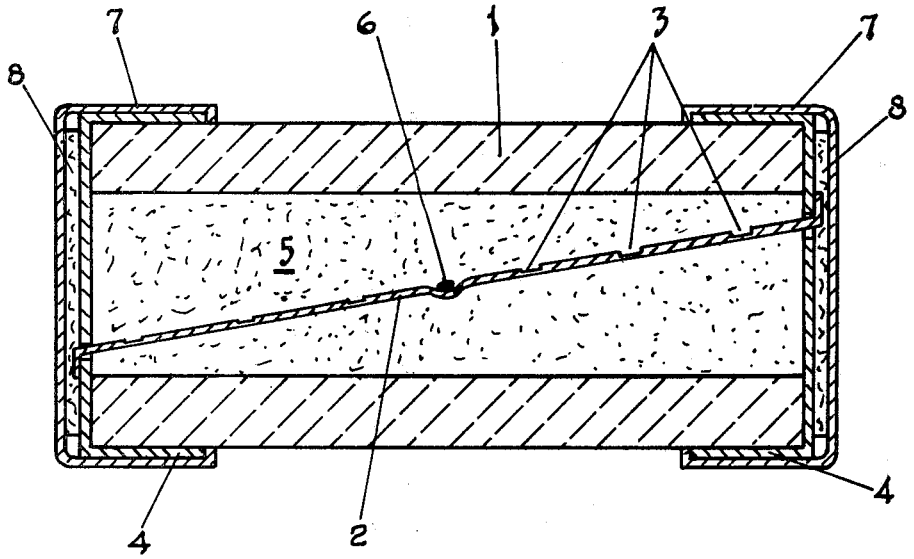
7
6
1
3
7
8
8
5
4
2
4

ELECTRIC FUSES WITH REGIONS OF REDUCED CROSS-SECTIONAL AREA

This invention relates to electric fuses of the type which incorporate a fuse element having regions of reduced cross-sectional area, these regions serving as sites where rupture of the element may occur in the event of an overcurrent surge.

When such an electric fuse is subjected to an overcurrent of appropriate magnitude, rupture of the element may occur at one such region only and this region may be that one which is nearest an end of the fuse element and near to a corresponding metal end cap of the fuse; and if conditions are such that extinction of the arc does not occur before it has elongated so far that it reaches the metal end cap, this latter may become perforated with a consequential release of arc products and possible damage to the fuse carrier. A proposal to prevent such occurrences by interposing layers of asbestos between the ends of the fuse element and the inside surfaces of the ends of the end caps has not proved adequate under the most onerous circuit conditions.

It is an object of this invention to provide an improved electric fuse of the above type with more dependable means for reducing the risk of perforation of the metal end cap as described above.

According to this invention an electric fuse incorporating a tubular body of insulating material, metal end caps on the respective ends of the tubular body and an elongate fuse element having regions of reduced cross-sectional area and extending through the tubular body in electrical series between the metal end caps, wherein the fuse incorporates within each end a respective gasket of an absorbent material impregnated with an arc-inhibiting substance. Materials which have been found to be particularly effective for the gaskets are asbestos and absorbent types of paper, including strawboard and cardboard, impregnated with an arc-inhibiting compound constituted, suitably, by sodium silicate. The impregnation may be effected by soaking the absorbent material of the gasket in a solution of the arc-inhibiting substance and then drying it, though, in the case of strawboard, for example, the manufacturing process may itself result in a sufficient impregnation with sodium silicate to achieve the desired result.

An embodiment of the invention will now be described by way of an example with reference to the accompanying drawing of a sectional view of a fuse according to the invention.

The electric fuse shown in the drawing comprises a cylindrical ceramic tube 1 and a fuse element 2 which extends the length of the inside of the tube and protrudes slightly from the tube at each end. The fuse element 2 has a number of grooves 3 at which it is of reduced cross-sectional area, and is held in position in the ceramic tube 1 by two cup-shaped element end members 4, each of which fits over an end of the ceramic tube and has a respective end of the fuse element 2 in electrical contact with it. The remaining space in the ceramic tube is filled with a suitable filling material such as sand 5, and the fuse element 2 may, as shown, be provided with a spot of solder 6 which, in known manner, will diffuse into the element 2 in the event of a prolonged low overload and will result in rupture of the element even if the current overload is insufficient to cause rupture at the grooves 3. A cup-shaped metal end-cap 7 of the fuse fits tightly over the sides of each element end member 4, in electrical contact with it and defining a cavity between the base of the element end member 4 and the inside of each end cap 7. The cavities each contain a gasket 8 made from strawboard which has been previously impregnated with sodium silicate.

In the event of the fuse element rupturing under current overload at only that one of the grooves 3 which is nearest to one of the element end members 4, it is possible that the arc which occurs there will not become extinguished before it has elongated to reach the element end member 4; but if that happens the water vapour released consequent on the heating of the adjacent gasket 8 which then occurs, will be effective to quench the arc before it is able to perforate the end of the adjacent end cap 7. The gasket may be impregnated with any substance which releases water vapour when heated by an electric arc, for example alumina trihydrate.

We claim:

1. An electric fuse incorporating a tubular body of insulating material, metal end caps on the respective ends of the tubular body and an elongate fuse element having regions of reduced cross-sectional area and extending through the tubular body in electrical series between the metal end caps, wherein the fuse also incorporates within each end cap a respective gasket of an absorbent material impregnated with an arc-inhibiting substance.

2. A fuse as claimed in claim 1 in which the absorbent material of the gasket is selected from strawboard, cardboard or asbestos.

3. A fuse as claimed in claim 1 or claim 2 in which the arc-inhibiting substance is a water-containing compound.

4. A fuse according to claim 3 in which the arc-inhibiting substance is hydrated sodium silicate.

5. A fuse according to claim 1 in which the tubular body contains a filling of inert particulate material with the fuse element embedded therein.

* * * * *